US012529272B2

(12) United States Patent
Guillot et al.

(10) Patent No.: US 12,529,272 B2
(45) Date of Patent: Jan. 20, 2026

(54) IDENTIFYING LOST-CIRCULATION EVENTS IN DOWNHOLE DRILLING SYSTEMS

(71) Applicant: Schlumberger Technology Corporation, Sugar Land, TX (US)

(72) Inventors: Valerian Guillot, Montpellier (FR); Alexey Ruzhnikov, Al-Khobar (SA); Mauricio Corona, Al-Khobar (SA); Khalid Abdelsamed M. Talha, Dhahran (SA)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/773,840

(22) Filed: Jul. 16, 2024

(65) Prior Publication Data

US 2025/0137334 A1 May 1, 2025

Related U.S. Application Data

(60) Provisional application No. 63/593,584, filed on Oct. 27, 2023.

(51) Int. Cl.

| | |
|---|---|
| ***E21B 21/00*** | (2006.01) |
| ***E21B 21/08*** | (2006.01) |
| ***E21B 44/00*** | (2006.01) |

(52) U.S. Cl.

CPC ..... *E21B 21/003* (2013.01); *E21B 21/08* (2013.01); *E21B 44/00* (2013.01)

(58) Field of Classification Search

CPC ..... E21B 21/003; E21B 21/08; E21B 44/00

See application file for complete search history.

(56) References Cited

U.S. PATENT DOCUMENTS

| | | | | |
|---|---|---|---|---|
| 11,795,814 | B2 | 10/2023 | Verma | |
| 2022/0120176 | A1* | 4/2022 | Gutarov | E21B 47/18 |
| 2022/0364424 | A1* | 11/2022 | Canizares | E21B 21/003 |

FOREIGN PATENT DOCUMENTS

| | | | |
|---|---|---|---|
| AU | 2020286411 | A1 | 1/2022 |
| CA | 2734642 | C | 3/2018 |

OTHER PUBLICATIONS

Veena S. Vezhapparambu et al., Estimating the blast sill thickness using changepoint analysis of MWD data, International Journal of Rock Mechanics and Mining Sciences, vol. 134, Oct. 2020, 104443.

* cited by examiner

*Primary Examiner* — Dany E Akakpo
(74) *Attorney, Agent, or Firm* — Jeffrey D. Frantz

(57) ABSTRACT

A drilling fluid management system may measure drilling parameters for a downhole drilling system, the drilling parameters including standpipe pressure. A drilling fluid management system may determine, based on the drilling parameters, a mechanical specific energy (MSE). A drilling fluid management system may apply a changepoint model to the MSE and the standpipe pressure to identify a plurality of MSE segments and a plurality of pressure segments. A drilling fluid management system may identify an expected MSE and an expected pressure. A drilling fluid management system may identify an MSE segment having the segment MSE that differs from the expected MSE by an MSE threshold, and a pressure segment having the segment pressure that differs from the expected pressure by a pressure threshold. A drilling fluid management system may identify a lost-circulation period based on an overlap of the MSE segment and the pressure segment.

12 Claims, 8 Drawing Sheets

IDENTIFYING LOST-CIRCULATION EVENTS IN DOWNHOLE DRILLING SYSTEMS

CROSS REFERENCE TO RELATED APPLICATIONS

This is a non-provisional patent application of co-pending U.S. Provisional Patent Application Ser. No. 63/593,584 to Valerian Guillot, filed on Oct. 27, 2023, and entitled "IDENTIFYING LOST-CIRCULATION EVENTS IN DOWNHOLE DRILLING SYSTEMS," which is hereby incorporated by reference in its entirety for all intents and purposes by this reference.

BACKGROUND OF THE DISCLOSURE

Downhole drilling often involves degrading a formation by rotating a drill bit against a formation at the bottom of a wellbore. Drilling fluid, or drilling mud, is often circulated through the wellbore from a mud pit on the surface to the drill bit. The drilling fluid may cool the drill bit, collect the cuttings generated by the drill bit, and carry the cuttings to the surface. The formula of a drilling fluid is often engineered to have particular properties, such as shear strength, density, viscosity, and so forth.

During drilling activities, the drilling assembly may encounter portions of the formation through which the drilling fluid may be more conductive, or through which the drilling fluid may flow. This may cause the drilling fluid to pass into the formation, reducing the circulation of the drilling fluid. If the conductivity of the formation is sufficiently high, then the drilling system may experience a lost-circulation event. Lost-circulation events may result in significant lost time and production for drilling systems.

SUMMARY

In some aspects, the techniques described herein relate to a method for identifying a lost-circulation event in a downhole drilling system. A drilling fluid management system measures drilling parameters for the downhole drilling system. The drilling parameters include standpipe pressure. The drilling fluid management system determines, based on the drilling parameters, a mechanical specific energy (MSE). The drilling fluid management system applies a changepoint model to the MSE and the standpipe pressure to identify a plurality of MSE segments and a plurality of pressure segments. Each MSE segment has a segment MSE and each pressure segment has a segment pressure. The drilling fluid management system identifies an expected MSE for each MSE segment of the plurality of MSE segments and an expected pressure for each pressure segment of the plurality of pressure segments. The drilling fluid management system identifies an MSE segment of the plurality of MSE segments having the segment MSE that differs from the expected MSE in the MSE segment by an MSE threshold. The drilling fluid management system identifies a pressure segment of the plurality of pressure segments having the segment pressure that differs from the expected pressure in the pressure segment by a pressure threshold. The drilling fluid management system identifies a lost-circulation period based on an overlap of the MSE segment and the pressure segment.

In some aspects, the techniques described herein relate to a method for identifying lost-circulation events in a downhole drilling system. A drilling fluid management system receives time-series drilling parameters for the downhole drilling system. The time-series drilling parameters include torque, rotation per minute (RPM), rate of penetration (ROP), weight-on-bit (WOB), and standpipe pressure. The drilling fluid management system determines a mechanical specific energy (MSE) based on the torque, RPM, ROP, and WOB. The drilling fluid management system generates an expected MSE and an expected pressure based on the time-series drilling parameters. The drilling fluid management system applies a changepoint model to the MSE and the standpipe pressure to identify a plurality of segments. The drilling fluid management system identifies a lost-circulation event based on an MSE comparison between the MSE and the expected MSE and a pressure comparison between the standpipe pressure and the expected pressure.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure may be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which.

DETAILED DESCRIPTION

This disclosure generally relates to devices, systems, and methods for identifying voids in the formation through which a wellbore is drilled. Voids in a formation may result in reduced and/or lost circulation of drilling flid in a wellbore. Such lost-circulation events may result in delays to drilling operations and/or damage to drilling equipment. Such delays and damage may increase drilling costs and/or delays to the completion of the wellbore. Typically, a drilling operator may manually monitor various drilling parameters to identify a lost-circulation event. This manual monitoring process may rely on highly educated and/or trained individuals, and such operators may rely on a combination of quantitative and qualitative observations. This may result in inconsistent identification of voids in the formation and/or increase the cost of void identification.

In accordance with at least one embodiment of the present disclosure, a drilling manager may calculate a mechanical specific energy (MSE) for drilling parameters, including weight-on-bit (WOB), torque, rotational rate (in rotations per minute (RPM)), and rate of penetration (ROP). The drilling manager may apply a changepoint model to time-series drilling parameters used to calculate the MSE. The drilling manager may further apply the changepoint model to the time-series drilling parameter of drilling fluid pressure as measured at the standpipe. The drilling manager may identify a void in the formation by determining whether a segment of the MSE and a segment of the drilling fluid pressure are below anticipated values. Time-series drilling parameters may be drilling parameters that are measured periodically over time, with the time of measurement associated with each measurement, or a duration between measurements that may be used to determine the time of measurement.

Figure 1:
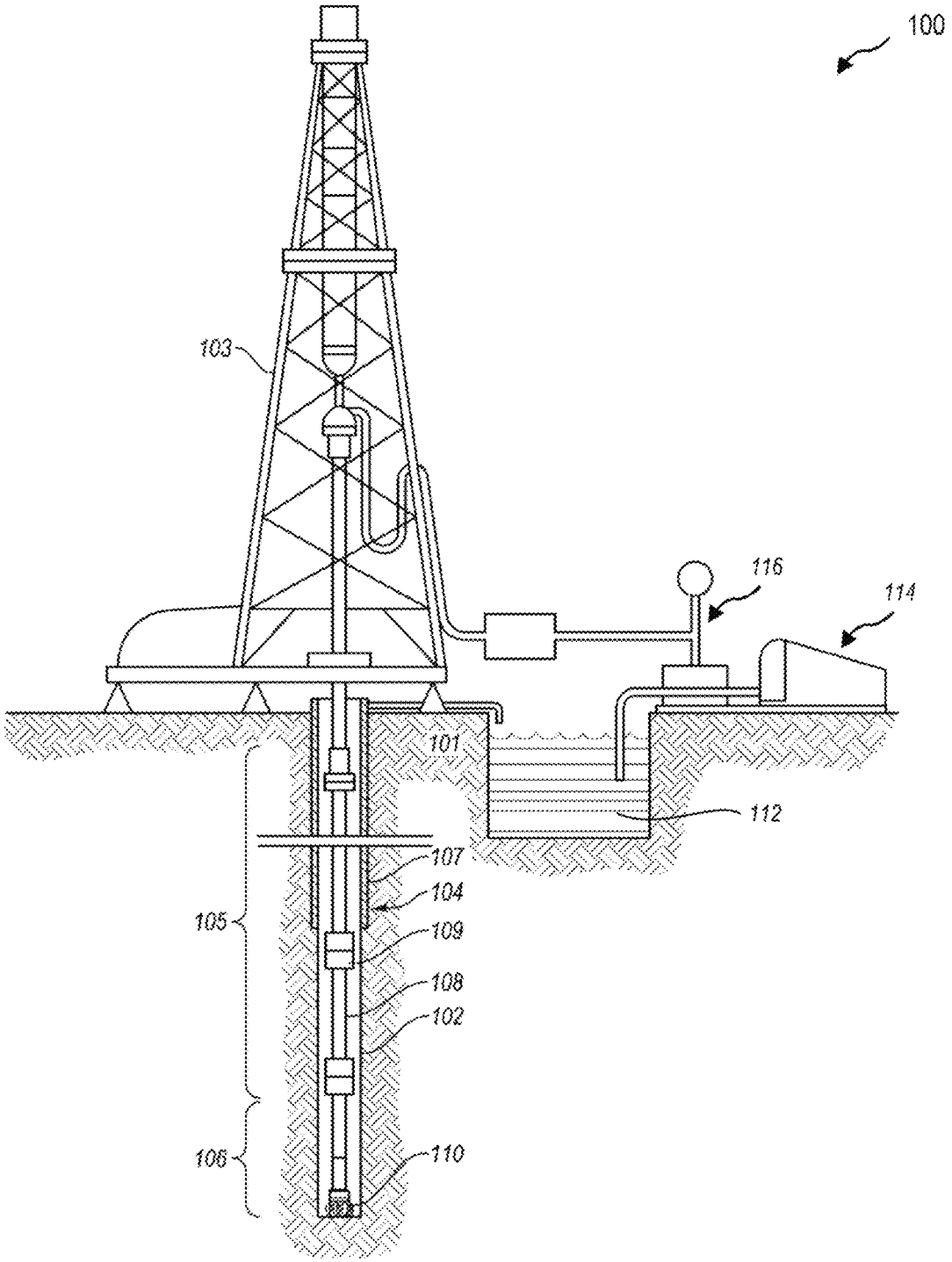
FIG. 1 is a representation of a downhole drilling system, according to at least one embodiment of the present disclosure.

FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

Drilling fluid may be stored on the surface at a mud pit 112. Drilling fluid may be pumped into the drill string 105 using one or more fluid pumps 114. The drilling fluid may pass through a standpipe 116 prior to entering the drill string 105. Drilling fluid is pumped into the drill string 105 with a drilling fluid pressure. The drilling fluid pressure helps to pass through the drill string 105, out of the bit 110, through the annulus of the wellbore 102 between the drill string 105 and the sidewall of the wellbore 102, and back into the mud pit 112. The drilling fluid pressure may be measured at the standpipe 116.

During drilling operation, a drilling operator may monitor the drilling fluid pressure measured at the standpipe 116. The drilling operator may operate the fluid pumps 114 to maintain the drilling fluid pressure within a threshold pressure range. If the drilling fluid pressure is too high (e.g., the drilling fluid pressure is above the threshold pressure range), then the drilling fluid may cause damage to the elements of the BHA 106. A drilling operator may monitor the drilling pressure to determine trends in the drilling pressure. An increase or decrease in the drilling pressure over time may be an indication of one or more changes to the downhole drilling conditions and/or operation of one or more downhole tools.

As discussed above, the drilling fluid may pass from the interior of the drill string 105 and into the annulus between the drill string 105 and the wall of the wellbore 102. If the earth formation 101 includes a void, the drilling fluid may enter the void. This may reduce the amount of the drilling fluid that is returned to the mud pit 112. Larger voids in the earth formation 101 may result in greater losses in the drilling fluid and/or decreases in the drilling fluid pressure. In some situations, the size of the void may result in a complete loss of drilling fluid and/or drilling fluid pressure. Blind drilling (e.g., drilling without return of drilling fluid) may result in damage to drilling equipment based on the flid level and/or the portion of the drill string that is not covered by drilling fluid.

In accordance with at least one embodiment of the present disclosure, voids in the earth formation 101 may be identified by monitoring the fluid pressure and drilling fluid parameters. For example, when the fluid pressure, measured at the standpipe 116, decreases, then the drilling operator may determine that the BHA 106 has entered a void in the earth formation 101 and/or that there has been an influx of fluid entering the wellbore. For example, a reduction in the weight-on-bit (WOB) and torque may indicate that the bit 110 has entered a void. Further, an increase in the rotational rate in rotation per minute (RPM) and/or rate of penetration (ROP) may indicate that the bit 110 has entered a void.

In some embodiments, the drilling operator may monitor a mechanical specific energy (MSE) of the drilling system. MSE is a computed parameter that incorporates measured drilling parameters and the wellbore diameter to generate a quantification of the energy used to advance the wellbore. The MSE may be computed as shown:

$$MSE = \frac{\text{Torque} * RPM}{ROP * \text{Bit Area}} + \frac{WOB}{\text{Bit Area}}$$

where torque is the measured drilling torque, RPM is the rotational rate in rotations per minute (RPM), ROP is the rate of penetration, bit area is the cutting area of the bit, and WOB is the weight-on-bit. As may be seen, the MSE increases as torque, RPM, and WOB increase. The MSE decreases as the ROP increases and the bit area increases.

A drilling fluid manager may apply a changepoint model to time-series drilling parameters used to calculate the MSE and the measured drilling fluid pressure. The changepoint model may identify segments of steady-state MSE and drilling fluid pressure. For example, the changepoint model may identify segments when the MSE and/or the drilling fluid pressure changes between steady-state values.

A comparison engine may compare MSE segments of the MSE data and pressure segments of the pressure data to predicted values during one or more of the changepoint segments. If the comparison engine identifies that the MSE in an MSE segment is lower than the predicted value, then the comparison engine may identify a softer-than-anticipated formation. If the comparison engine identifies that the pressure in a pressure segment is lower than the predicted value, then the comparison engine may identify a formation that is conductive to fluids. In accordance with at least one embodiment of the present disclosure, if the comparison engine identifies a length of the wellbore where an MSE segment is lower than the predicted value and a pressure segment is lower than the predicted value, then a void identifier may identify that that portion of the wellbore is a void in the formation 101. In this manner, by monitoring the MSE and the drilling pressure together, the drilling fluid manager may identify voids in the formation with greater accuracy and/or reliability.

In some embodiments, when the fluid manager identifies a void in the earth formation 101, the fluid manager may provide a recommendation to implement and/or directly implement a mitigation procedure. For example, if the fluid manager identifies a void in the earth formation 101, the fluid manager may provide a recommendation and/or implement adding an additive to the drilling fluid. In some examples, the fluid manager may provide a recommendation and/or implement installing a cement plug in the void. In some examples, the fluid manager may recommend and/or implement any other mitigation procedure. In this manner, the fluid manager may help to mitigate the impact of encountering a void in the earth formation 101.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing. The BHA 106 may further include a rotary steerable system (RSS). The RSS may include directional drilling tools that change a direction of the bit 110, and thereby the trajectory of the wellbore. At least a portion of the RSS may maintain a geostationary position relative to an absolute reference frame, such as gravity, magnetic north, and/or true north. Using measurements obtained with the geostationary position, the RSS may locate the bit 110, change the course of the bit 110, and direct the directional drilling tools on a projected trajectory.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

Figure 2:
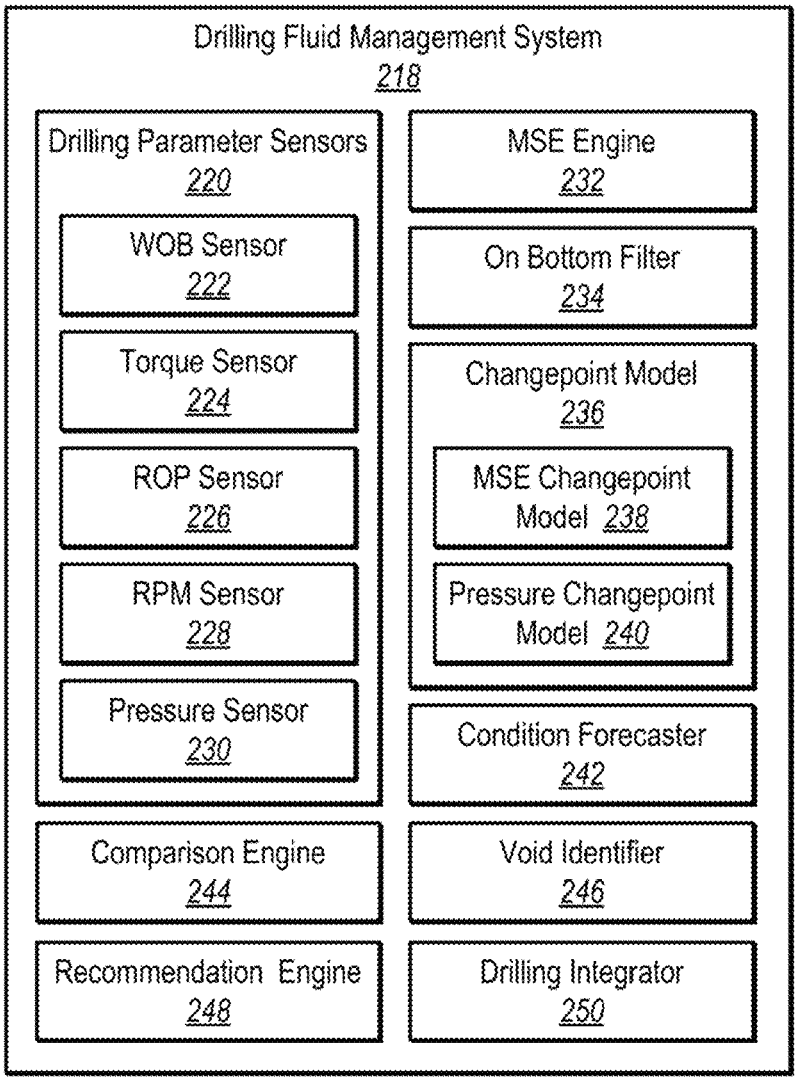
FIG. 2 is a schematic representation of a drilling fluid management system, according to at least one embodiment of the present disclosure.

FIG. 2 is a schematic representation of a drilling fluid management system 218, according to at least one embodiment of the present disclosure. Each of the components of the drilling fluid management system 218 may include software, hardware, or both. For example, the components may include one or more instructions stored on a computer-readable storage medium and executable by processors of one or more computing devices, such as a client device or server device. When executed by the one or more processors, the computer-executable instructions of the drilling fluid management system 218 may cause the computing device(s) to perform the methods described herein. Alternatively, the components may include hardware, such as a special-purpose processing device to perform a certain function or group of functions. Alternatively, the components of the drilling fluid management system 218 may include a combination of computer-executable instructions and hardware.

Furthermore, the components of the drilling fluid management system 218 may, for example, be implemented as one or more operating systems, as one or more stand-alone applications, as one or more modules of an application, as one or more plug-ins, as one or more library functions or functions that may be called by other applications, and/or as a cloud-computing model. Thus, the components may be implemented as a stand-alone application, such as a desktop or mobile application. Furthermore, the components may be implemented as one or more web-based applications hosted on a remote server. The components may also be implemented in a suite of mobile device applications or "apps."

The drilling fluid management system 218 may monitor drilling fluid parameters to identify voids in the formation through which a wellbore is drilled. For example, the drilling fluid management system 218 may include drilling parameter sensors 220. The drilling parameter sensors 220 may include any type of drilling sensor. For example, the drilling parameter sensors 220 may include a hookload sensor 222. The hookload sensor 222 may measure the hookload (in tension) on the hook supporting the drill string. The hookload may be used to calculate the WOB, such as by subtracting the difference between the free weight of the drill string and BHA and any friction forces from the hookload. This value may be converted to the WOB. For ease of explanation, the hookload sensor 222 is described as measuring the WOB, however it should be understood that, as discussed herein, the hookload sensor 222 may measure a property that is calculated to be the WOB. In some embodiments, the hookload sensor 222 may measure the WOB at the surface. For example, the hookload sensor 222 may measure the hookload and the drilling fluid management system 218 may infer a WOB based on a linear weight of the drill string reduced by a friction applied to the drill string through contact with the wellbore wall. In some examples, the hookload sensor 222 may measure the WOB downhole. For example, the BHA may include one or more sensors that may measure the force applied to the bit (or other element of the BHA uphole of the bit) and may determine the WOB based on the applied force.

The drilling parameter sensors 220 may further include a torque sensor 224. The torque sensor 224 may measure the torque applied to the drilling system. In some embodiments, the torque sensor 224 may measure the torque applied to the drill string at the surface, such as the torque applied by the turntables on the drill rig. In some embodiments, the torque sensor 224 may measure the torque applied to the bit downhole, such as using a torque sensor located at the BHA, on the bit, or otherwise proximate to the bit. In some embodiments, the measured torque may be a torque-on-bit (TOB). In some embodiments, the measured torque may be the torque applied to the entire drill string.

The drilling parameter sensors 220 may further include a hole depth sensor 226. The hole depth sensor 226 may include any mechanism used to measure the hole depth, including manual changes, downhole surveys, estimations on surface from the rate of adding drill pipe to the hole, any other mechanism, and combinations thereof. The ROP may be determined based on the difference in hole depth over a period of time. For ease of explanation, the hole depth sensor 226 is described herein as measuring ROP. However, it should be understood that the ROP may be determined based on a combination of measurements, manual inputs, and other inputs that identify the rate of change in the hole depth over time.

The drilling parameter sensors 220 may further include an RPM sensor 228. The RPM sensor 228 may measure the rotational rate of the drill string. In some embodiments, the RPM sensor 228 may measure the rotational rate of the drill string at the surface. In some embodiments, the RPM sensor 228 may measure the rotational rate of the bit downhole at the BHA and/or at the bit.

The drilling parameter sensors 220 may further include a pressure sensor 230. The pressure sensor 230 may measure the drilling fluid pressure of the drilling fluid used during drilling activities. In some embodiments, the pressure sensor 230 may measure the drilling fluid pressure at the standpipe. This may be a representation of the drilling fluid pressure as applied by the fluid pumps. In some embodiments, the pressure sensor 230 may measure the drilling fluid pressure at a downhole location. In some embodiments, the drilling parameter sensors 220 may include multiple pressure sensors to determine a differential drilling fluid pressure between two locations on the BHA.

While embodiments of the drilling parameter sensors 220 have been described with respect to a single sensor and/or set of sensors, it should be understood that each of the drilling parameter sensors 220 may include multiple sensors. For example, the drilling parameter sensors 220 may include multiple sensors in the same location. In some examples, the drilling parameter sensors 220 may include multiple sensors in different locations. In some embodiments, two different sensors of the drilling parameter sensors 220 may be located in the same location.

In some embodiments, the drilling parameter sensors 220 may measure time-series data. For example, the drilling parameter sensors 220 may measure multiple measurements of the drilling parameters, with each measurement associated with a time stamp. The drilling parameter sensors 220 may measure the drilling parameters periodically and/or episodically. For example, the drilling parameter sensors 220 may measure the drilling parameters with a measurement frequency, with one or more measurements taken per period of time. In some embodiments, the measurement frequency may be in a range having an upper value, a lower value, or upper and lower values including any of 0.01 Hz, 0.1 Hz, 1 Hz, 10 Hz, 100 Hz, 1 kHz, 10 kHz, 100 kHz, or any value therebetween. For example, the measurement frequency may be greater than 0.01 Hz. In another example, the measurement frequency may be less than 100 kHz. In yet other examples, the measurement frequency may be any value in a range between 0.01 Hz and 100 kHz.

In some examples, the drilling parameter sensors 220 may measure the drilling parameters episodically, or based on pre-determined events. For example, the drilling parameter sensors 220 may measure the drilling parameters when the bit is on bottom, when the bit is being lowered and/or rotated, when another sensor is taking a measurement, any other pre-determined event, and combinations thereof.

An MSE engine 232 may calculate the MSE using the WOB measured by the hookload sensor 222, the torque measured by the torque sensor 224, the ROP measured by the hole depth sensor 226, and the RPM measured by the RPM sensor 228. In some embodiments, the MSE engine 232 may generate a time-series MSE calculations. In some embodiments, the time-series MSE may be calculated based on the measurement having the smallest frequency. In some embodiments, the time-series MSE may be calculated based on the measurement having a higher frequency than the smallest frequency; any measurements having a shorter frequency may utilize one of the earlier measurement, the later measurement, an average between the earlier and later measurement, or any other value between the earlier and later measurement. This may result in time-series MSE having a greater frequency, and thereby greater resolution.

An on bottom filter 234 may filter the time-series data to only include measurements taken when the bit is located on bottom. For example, the on bottom filter 234 may remove measurements taken when the bit is removed from the bottom of the wellbore for any reason, including adding drill string, removing drill string, directional surveys, formation survey, equipment monitoring, equipment activation/deactivation, any other reason, and combinations thereof. The on bottom filter 234 may identify when the bit is off bottom in any manner. For example, the on bottom filter 234 may identify that the bit is off bottom based on a threshold WOB, a threshold torque, a threshold drilling fluid pressure, any other metric, and combinations thereof.

In some embodiments, the on bottom filter 234 may filter the WOB, the torque, the ROP, and the RPM before the MSE engine 232 calculates the MSE. In some embodiments, the on bottom filter 234 may filter the MSE after the MSE engine 232 calculates the MSE. In some embodiments, the on bottom filter 234 may filter the drilling fluid pressure measured by the 230. The resulting data series generated by the on bottom filter 234 may be a filtered time-series MSE and a filtered time-series drilling fluid pressure (or filtered time-series pressure).

The drilling fluid management system 218 may include a changepoint model 236. The changepoint model 236 may be applied to the filtered time-series MSE and the filtered time-series pressure. The changepoint model 236 may segment the filtered time-series data into multiple segments. Each segment may have a constant or relatively constant value, and the difference between segments may be determined by a change in the steady-state value. Put another way, the changepoint model 236 may identify a changepoint in the time-series data, or a point where the statistical properties of the data change.

As a specific, non-limiting example, the changepoint model 236 may initialize a segment and compute a cost function for each datapoint in the time-series, as shown below:

$$C(\tau) = \sum_{i=1}^{m+1} c(\tau_{i-1} + 1, \tau_i) + \beta m$$

where $C(\tau)$ is the total cost for a particular segmentation $\tau$, $\tau=\{\tau_0, \tau_1, \ldots, \tau_m\}$ represents the set of changepoints in the sequence, with $\tau_0=0$ and $\tau_m=n$ represent the bounds of the length of the sequence, $c(\tau_{i-1}+1, \tau_i)$ represents the cost of the segment between changepoints i and i−1, m is the number of detected changepoints, and $\beta$ is a penalty term for each changepoint. A pruning step prunes the list of candidate change points by removing those that will not minimize the cost function in the future.

The changepoint model 236 seeks to find the segmentation $\tau$ that minimizes the total cost $C(\tau)$, balancing the fit to the data and the number of detected change points through the penalty term $\beta$. The pruning step efficiently eliminates non-minimizing segmentations, ensuring that the algorithm operates in linear time. In some embodiments, the changepoint model 236 may be operated in real-time. This may help to identify changepoints in the MSE and/or the pressure in real-time, thereby identifying voids as the drilling system encounters them.

The changepoint model 236 may identify the characteristics of each segment. The segments may be identified between start time and hole depth and end time and hole depth. In some embodiments, the changepoint model 236 may identify characteristics of each segment such as MSE, pressure, WOB, torque, ROP, RPM, any other characteristic, and combinations thereof.

In some embodiments, the changepoint model 236 may process the time-series data. In some embodiments, the changepoint model 236 may process a derivative of the time-series data. For example, the changepoint model 236 may process a first-order derivative of the time-series data (e.g., the velocity) and/or a second-order derivative of the time-series data (e.g., the acceleration). Applying the changepoint model 236 to a derivative of the time-series data may identify changepoints in the rates of change.

In some embodiments, the changepoint model 236 may be applied to a combination of the individually measured parameters that comprise the MSE and the drilling fluid pressure. In this manner, the changepoint model 236 may separate the drilling system into segments having consistent characteristics.

In some embodiments, the changepoint model 236 includes multiple changepoint models that may be applied to different sets of time-series data. For example, the changepoint model 236 may include an MSE changepoint model 238. The MSE changepoint model 238 may be applied to the filtered time-series MSE. The MSE changepoint model 238 may generate a plurality of MSE segments.

In some examples, the changepoint model 236 may include a pressure changepoint model 240. The pressure changepoint model 240 may be applied to the filtered time-series pressure. The pressure changepoint model 240 may generate a plurality of pressure segments.

In some embodiments, the MSE segments and the pressure segments may have the same length (e.g., the same time period and/or the same hole depth). In some embodiments, the MSE segments and the pressure segments may have different lengths (e.g., different time periods and/or different hole depths). For example, the MSE changepoint model 238 may be applied to the filtered time-series MSE independently of the pressure changepoint model 240, and may independently generate the MSE segments. The pressure changepoint model 240 may be applied to the filtered time-series pressure independently of the MSE changepoint model 238, and may independently generate the pressure segments. This may result in MSE segments and pressure segments that have different start times, start hole depths, end times, end depths, durations, lengths, and combinations thereof. In some embodiments, the filtered time-series MSE may have a different number of MSE segments than the filtered time-series pressure has pressure segments. These differences may be based on the difference in behavior of the drilling fluid pressure and the MSE. In some embodiments, an MSE quantity of the MSE segments may be different than a pressure quantity of the pressure segments.

A condition forecaster 242 may forecast a condition of the wellbore at a particular depth and/or period in time. The condition forecaster 242 may generate an expected condition of the wellbore using any forecasting methodology. For example, the condition forecaster 242 may forecast the condition of the wellbore using a trendline (e.g., linear, quadrinomial, exponential, or other trendline), Kalman filter, or other forecast technique.

In some embodiments, the condition forecaster 242 may incorporate known anomalies into the expected condition. For example, the condition forecaster 242 may incorporate a known uplink and/or downlink period into the expected pressure. An uplink and/or downlink period may result in a reduced expected standpipe pressure. In some examples, the condition forecaster 242 may incorporate a known change in formation into the expected WOB, torque, ROP, RPM, MSE, and combinations thereof. In some examples, the condition forecaster 242 may incorporate a known change in operating status of one or more drilling tools into the expected conditions. For example, the condition forecaster 242 may incorporate the actuation and/or de-actuation of one or more expandable drilling tools, such as an expandable reamer, stabilizer, casing cutter, or other expandable drilling tool. Actuation and/or de-actuation of an expandable drilling tool may result in a change in the drilling fluid pressure and/or a change in the WOB, torque, ROP, RPM, MSE, and combinations thereof. Incorporating known anomalies into the expected condition may help to make the expected condition more representative of the actual condition. As discussed in further detail herein, this may help to reduce false-positives in the identification of voids.

In some embodiments, the condition forecaster 242 may generate expected conditions for each individual drilling parameter measured by the drilling parameter sensors 220. In some embodiments, the condition forecaster 242 may generate expected conditions for the time-series data to which the changepoint model 236 is applied. For example, the condition forecaster 242 may generate an expected MSE for the filtered time-series MSE generated by the MSE changepoint model 238 and based on the filtered time-series MSE data. In some examples, the condition forecaster 242 may generate an expected WOB, torque, ROP, and RPM based on the measurements from the hookload sensor 222, the torque sensor 224, the hole depth sensor 226, and the RPM sensor 228. The MSE engine 232 may calculate the expected MSE based on the expected measurements. In some examples, the condition forecaster 242 may generate expected pressure data based on the measurements of the pressure sensor 230.

In some embodiments, the condition forecaster 242 may generate the expected conditions at the same frequency as the measurement frequency. In some embodiments, the condition forecaster 242 may generate the expected conditions for each segment generated by the changepoint model 236.

A comparison engine 244 may provide a comparison between the expected condition and the segments identified by the changepoint model 236. If the MSE at a particular MSE segment is lower than the expected MSE, then the comparison engine 244 may identify that the drilling system has entered a relatively softer formation or a portion of the formation that is easier to drill through. If the drilling fluid pressure at a particular pressure segment is lower than the expected drilling fluid pressure at a particular pressure segment, then the comparison engine 244 may identify that the drilling system has entered a formation that is more conductive to drilling fluid and/or a portion of the formation that is more conductive to drilling fluid.

A void identifier 246 may identify a void in the formation based on the comparison by the comparison engine 244. For example, the void identifier 246 may identify the presence of a void if the MSE in an MSE segment is lower than an MSE threshold and the drilling fluid pressure in a pressure segment is lower than a pressure threshold, where the pressure segment at least partially overlaps the MSE segment in duration and/or hole depth. This period of overlap between the MSE segment may be a lost-circulation period, or a period in which circulation was lost or partially lost. When both the MSE and the drilling fluid pressure are below the thresholds, this may show that the bit has entered a soft portion that is conductive to drilling fluid, thereby indicating that there may be a lost-circulation event at that time. If only the MSE is lower than the expected MSE or the drilling fluid pressure is lower than the expected pressure, then the drilling fluid management system 218 may identify that the drilling conditions have changed, but that there is no lost-circulation event.

In some embodiments the void identifier 246 may determine the MSE threshold and/or the pressure threshold. For example, the void identifier 246 may determine at what combination of MSE threshold and pressure threshold the wellbore has entered a lost-circulation event. In some embodiments, the MSE threshold and/or the pressure threshold may be input by a drilling operator. In some embodiments, the MSE threshold and/or the pressure threshold may be determined based on offset wellbores (e.g., wellbores located in the same or similar formation but offset a distance from the wellbore at issue).

In some embodiments, when the void identifier 246 identifies a void and/or a lost-circulation event based on the lost-circulation period identified, a recommendation engine 248 may prepare a recommendation to implement a mitigating action to mitigate the lost-circulation event. For example, the recommendation engine 248 may generate and present an alert to a drilling operator informing the drilling operator of the lost-circulation event. In some embodiments, the recommendation engine 248 may prepare a recommendation to take a mitigating action, such as adding one or more additives (in an additive amount and/or additive schedule), installing casing, installing a cement plug, any other mitigating action, and combinations thereof.

In accordance with at least one embodiment of the present disclosure, the drilling fluid management system 218 may include a drilling integrator 250 that may implement the mitigating action. For example, the drilling integrator 250 may instruct one or more valves or other control systems to automatically add an additive to the drilling fluid and mix them together. In some examples, the drilling fluid manager may provide an instruction to a drilling fluid engineer or other drilling operator to add the amounts of the additive to the drilling fluid.

The drilling integrator 250 may include an additive control system that may physically add the additives to the drilling fluid. For example, a fluid additive, including liquids, gels, slurries, and other fluids, may include one or more pipes, tanks, or other fluid conduits connected to the drilling fluid storage and/or a drilling fluid mixing chamber. The fluid storage systems may be connected to the drilling fluid mixing chamber with a valve and a volume control system (e.g., a flow meter, a timer, or other volume control system). Based on the determined additive amount and schedule, the additive manager may cause the additive control system to add the amount of the additive in the identified schedule.

In some examples, a fluid additive may include one or more solid materials, including powders, granules, bricks, or solid fluid additive. The solid fluid additive may be stored in a storage system, such as a hopper. The hopper may include an additive volume control. For example, the additive volume control may include one or more scales. The hopper may feed the solid additive into a container on the scales, and the scales may weigh the additive to the additive amount. The additive control system may then empty the container into the drilling fluid, such as in a drilling fluid mixing chamber. The additive control system may, to comply with the additive schedule and/or based on the container capacity, measure and add multiple batches of the additive. In this manner, the additive control system may help to automate the drilling fluid management process.

In some embodiments, when the void identifier 246 identifies that only one of the MSE segment or the pressure segment has a value that is lower than their respective thresholds, the recommendation engine 248 may generate and present a warning to the drilling operator. For example, the recommendation engine 248 may provide a warning to the operator based on the magnitude below the threshold, the length of time below the threshold, repeated temporary dips below the threshold, any other basis, and combinations thereof. In some examples, the warning may include a recommendation to implement one or more mitigating actions. In some embodiments, the drilling integrator 250 may implement the mitigating actions, as discussed herein.

Figure 3:
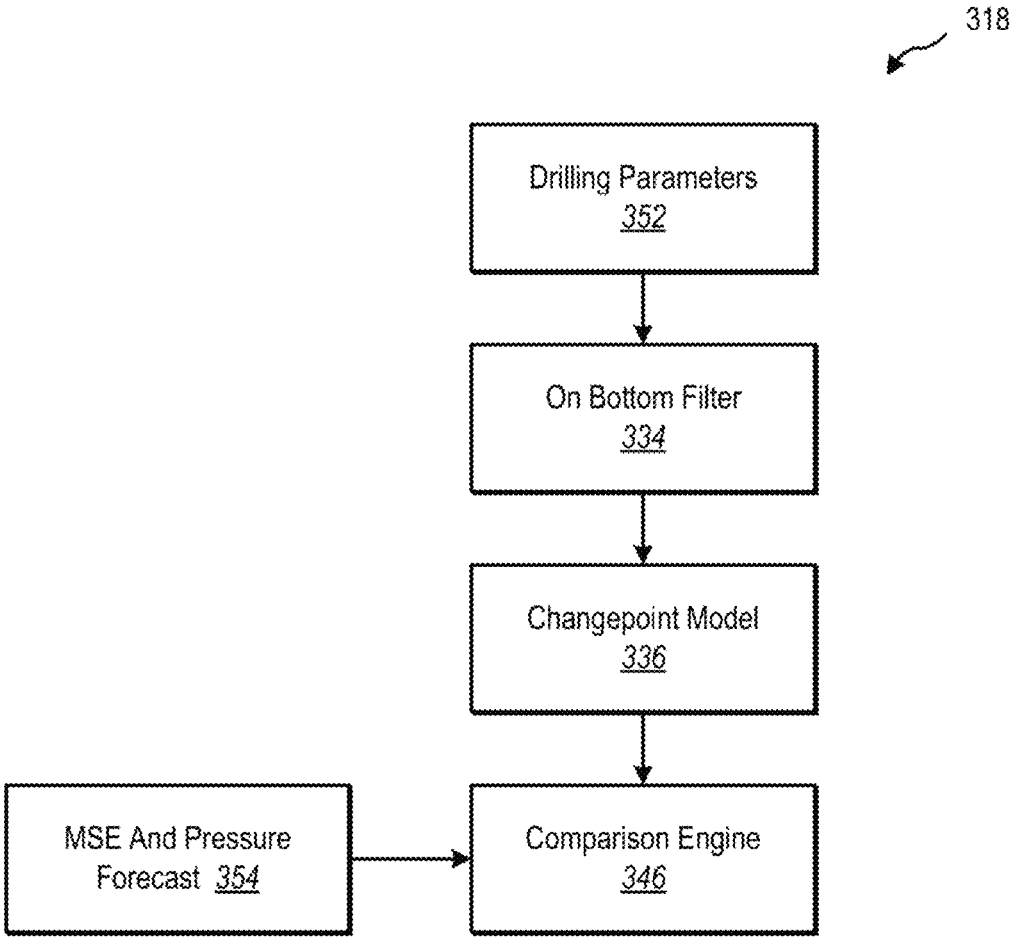
FIG. 3 is a schematic representation of a drilling fluid management system, according to at least one embodiment of the present disclosure.

FIG. 3 is a schematic representation of a drilling fluid management system 318, according to at least one embodiment of the present disclosure. In the embodiment shown, one or more sensors may collect drilling parameters 352. As discussed herein, the drilling parameters 352 may be collected using one or more drilling parameter sensors. In some embodiments, one or more of the drilling parameters 352 may be calculated or determined. For example, an MSE may be calculated using the drilling parameters 352.

An on bottom filter 334 may be applied to the drilling parameters 352. The on bottom filter may filter the drilling parameters 352 to remove the drilling parameters 352 measured when the bit is not located on the bottom of the wellbore.

The filtered drilling parameters 352 may be input into a changepoint model 336. The changepoint model 336 may segment the filtered drilling parameters 352 into a plurality of segments based on a change in the state of the filtered drilling parameters 352. A comparison engine 346 may compare the segment values from the segments generated by the changepoint model 336 with forecast parameters 354. If the comparison engine 346 determines that the conditions of a segment are below a threshold, then the comparison engine 346 may determine that the formation may include a void at that location and/or that the drilling system may be in a lost-circulation event.

Figure 4:
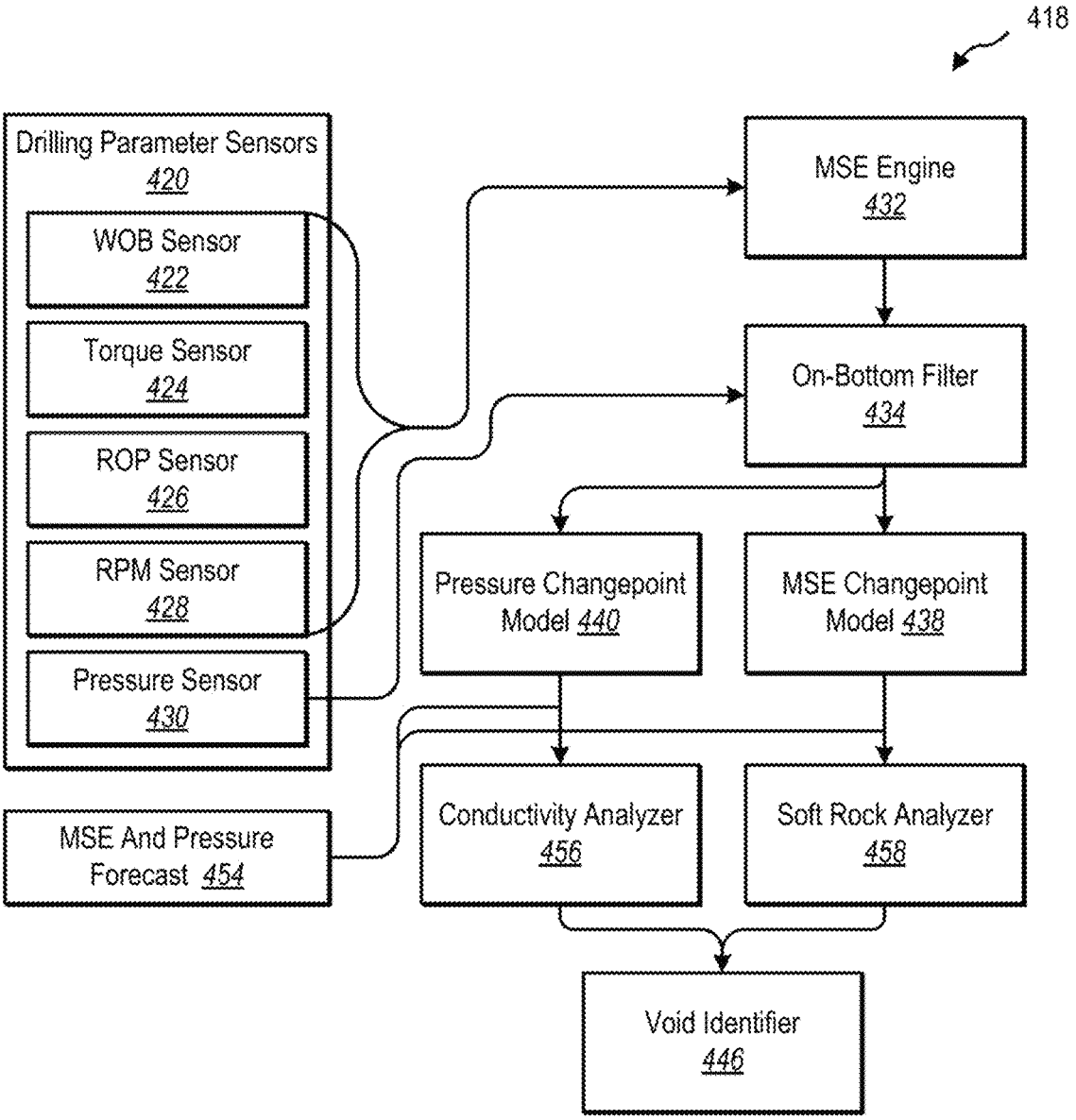
FIG. 4 is a representation of a drilling fluid management system, according to at least one embodiment of the present disclosure.

FIG. 4 is a representation of a drilling fluid management system 418, according to at least one embodiment of the present disclosure. In the drilling fluid management system 418 shown, drilling parameter sensors 420 may measure or collect drilling parameters. For example, a hookload sensor 422 may measure the WOB of the drilling system, a torque sensor 424 may measure the torque of the drilling system, a hole depth 426 may measure the ROP of the drilling system, an RPM senor 428 may measure the RPM of the drilling system, and a pressure sensor 430 may measure the drilling fluid pressure of the drilling system. As discussed herein, the parameter sensors 420 may collect and/or measure time-series data of their respective parameters.

An MSE engine 432 may calculate the MSE for the system based on the WOB measured by the hookload sensor 422, the torque measured by the torque sensor 424, the ROP measured by the hole depth 426, and the RPM measured by the RPM senor 428. The MSE engine 432 may calculate the MSE as a time-series MSE, or calculate the MSE at various times based on the measurement frequency of the parameter sensors 420.

An on bottom filter 434 may filter the time-series data to remove the measurements collected when the bit is off bottom. In some embodiments, the bottom filter 434 may be applied to the time-series MSE calculated by the MSE engine 432. However, it should be understood that the bottom filter 434 may be applied to each of the WOB, torque, ROP, and RPM before the MSE engine 432 calculates the MSE. The bottom filter 434 may further be applied to the drilling fluid pressure measured by the pressure sensor 430.

A changepoint model may be applied to the filtered time-series data. For example, a pressure changepoint model 440 may be applied to the filtered time-series pressure data and an MSE changepoint model 438 may be applied to the filtered time-series MSE data. As discussed herein, the pressure changepoint model 440 may generate a plurality of pressure segments having a segment pressure and the MSE changepoint model 438 may generate a plurality of MSE segments having a segment MSE.

A comparison engine may compare the segment pressure and segment MSE to forecast for expected values for the segment. For example, the comparison engine may receive forecast parameters 454, including expected MSE and expected pressure values. The comparison engine may include a conductivity analyzer 456. The conductivity analyzer 456 may compare the segment pressures from various pressure segments to the expected pressure values. If the segment pressure is lower than the expected pressure, the conductivity analyzer 456 may identify that the formation has a relatively higher fluid conductivity. In some embodiments, the expected pressure may be a pressure threshold. In some embodiments, the conductivity analyzer 456 may identify a high fluid conductivity when the segment pressure is lower than the expected pressure by a threshold amount.

The comparison engine may include a soft rock analyzer 458. The soft rock analyzer 458 may compare the segment MSEs from various MSE segments to the expected MSE values. If the segment MSE is lower than the expected MSE, the soft rock analyzer 458 may identify that the formation is relatively soft. In some embodiments, the expected MSE may be an MSE threshold. In some embodiments, the soft rock analyzer 458 may identify a soft formation when the segment MSE is lower than the expected MSE by a threshold amount.

A void identifier 446 may receive the comparison from the conductivity analyzer 456 and the soft rock analyzer 458 and determine whether a void is present and/or whether there is a lost-circulation event. For example, if the void identifier 446 identifies that the formation is highly conductive based on the conductivity analyzer 456 and the formation is soft based on the soft rock analyzer 458, then the void identifier 446 may identify a void and/or a lost-circulation event.

Figure 5:
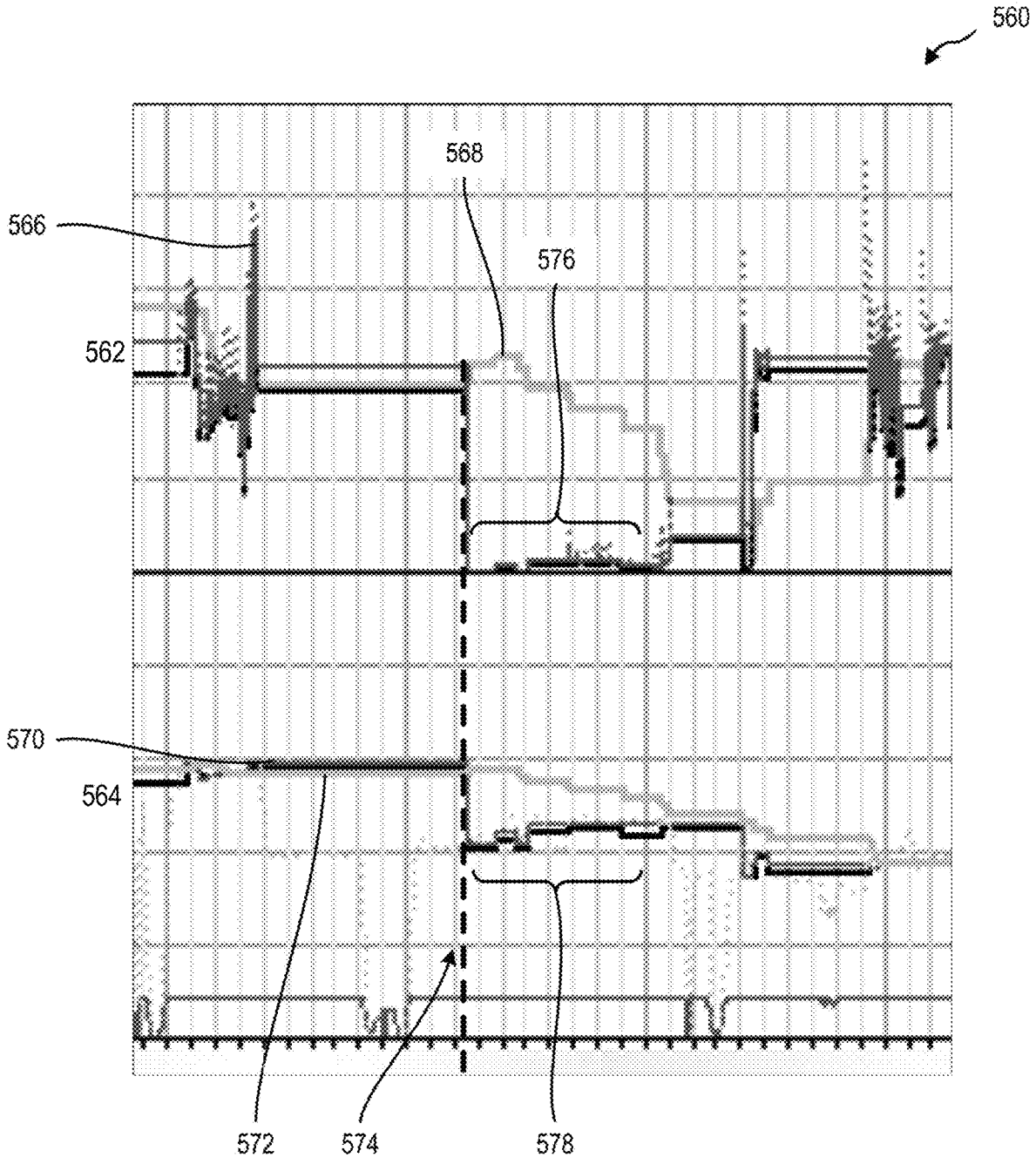
FIG. 5 is a representation of a drilling plot with time on the x-axis (e.g., horizontal axis), MSE on an upper y-axis (e.g., upper horizontal axis) and drilling fluid pressure on a lower y-axis (e.g., lower horizontal axis), according to at least one embodiment of the present disclosure.

FIG. 5 is a representation of a drilling plot 560 with time on the x-axis (e.g., horizontal axis), MSE 562 on an upper y-axis (e.g., upper horizontal axis) and drilling fluid pressure 564 on a lower y-axis (e.g., lower horizontal axis), according to at least one embodiment of the present disclosure. The upper y-axis includes a filtered time-series MSE plot 566 and an expected MSE plot 568. The lower y-axis includes a filtered time-series pressure plot 570 and an expected pressure plot 572.

As may be seen, at a first time 574, the MSE in an MSE segment 576 drops below the expected MSE and the pressure drops in a pressure segment 578 drops below the expected pressure. When the drilling fluid management system identifies that both the MSE and the pressure have dropped below the expected values, then the drilling fluid management system may determine that the drilling system experienced a lost-circulation event at this location.

Figure 6:
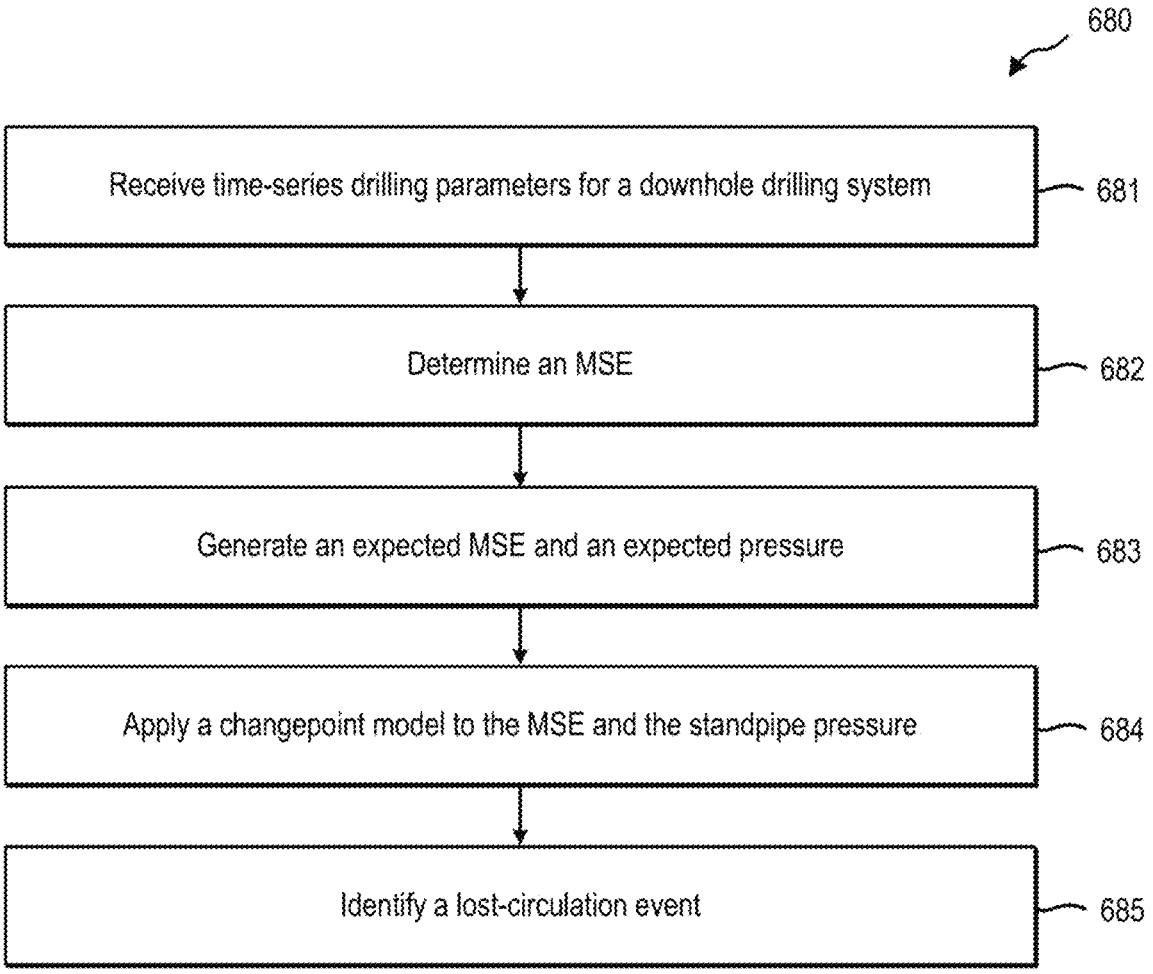
FIG. 6 is a flowchart of a method for identifying a lost-circulation event, according to at least one embodiment of the present disclosure.
Figure 7:
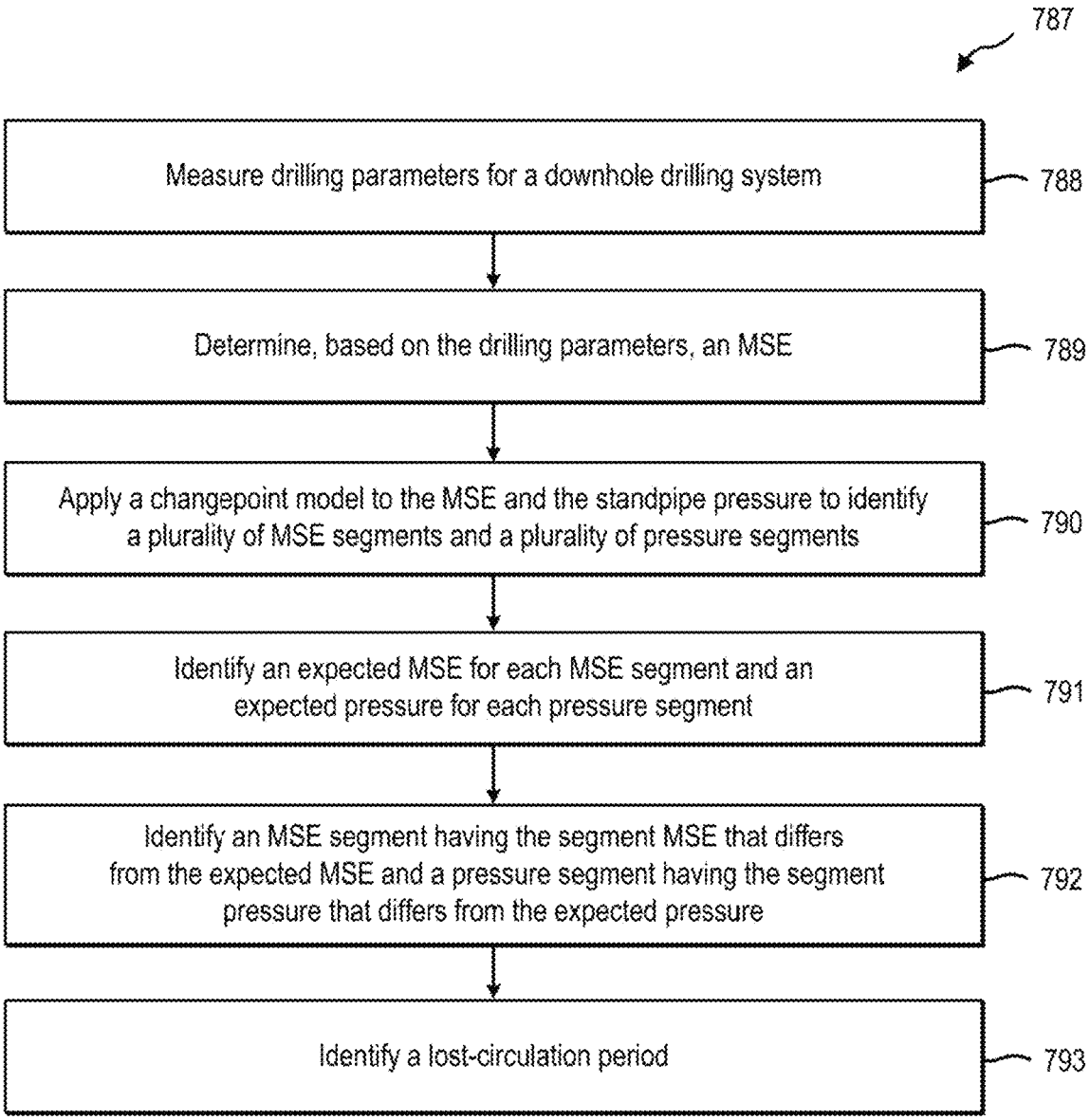
FIG. 7 is a flowchart of a method for identifying a lost-circulation event, according to at least one embodiment of the present disclosure.

FIGS. 6 and 7, the corresponding text, and the examples provide a number of different methods, systems, devices, and computer-readable media of the drilling fluid management system 218. In addition to the foregoing, one or more embodiments may also be described in terms of flowcharts comprising acts for accomplishing a particular result, as shown in FIGS. 6 and 7. FIGS. 6 and 7 may be performed with more or fewer acts. Further, the acts may be performed in differing orders. Additionally, the acts described herein may be repeated or performed in parallel with one another or parallel with different instances of the same or similar acts.

As mentioned, FIG. 6 illustrates a flowchart of a method 680 or a series of acts for managing a drilling fluid, according to at least one embodiment of the present disclosure. While FIG. 6 illustrates acts according to one embodiment, alternative embodiments may omit, add to, reorder, and/or modify any of the acts shown in FIG. 6. The acts of FIG. 6 may be performed as part of a method. Alternatively, a computer-readable medium may comprise instructions that, when executed by one or more processors, cause a computing device to perform the acts of FIG. 6. In some embodiments, a system may perform the acts of FIG. 6.

The drilling fluid management system may receive time-series drilling parameters for a downhole drilling system at 681. The time-series drilling parameters include at least one of torque, RPM, ROP, WOB, and standpipe pressure. The drilling fluid management system may determine an MSE for the downhole drilling system based on the torque, RPM, ROP, and WOB at 682. The drilling fluid management system may generate an expected MSE and an expected pressure based on the time-series drilling parameters at 683.

The drilling fluid management system may apply a changepoint model to the MSE and the standpipe pressure to identify a plurality of segments at 684. The drilling fluid management system may further identify a lost-circulation event at 686. The lost-circulation event may be identified based on a comparison between the MSE and the standpipe pressure and the expected MSE and the expected standpipe pressure. For example, the drilling fluid management system may perform an MSE comparison between the MSE and the expected MSE and a pressure comparison between the standpipe pressure and the expected pressure. If the MSE comparison identifies that the MSE is lower than the expected MSE and the pressure comparison identifies that the pressure is lower than the expected pressure, then the drilling fluid management system may identify that a lost-circulation event has occurred. In some embodiments, the drilling fluid management system may identify the lost-circulation event when the MSE comparison and the pressure comparison occur at the same segment.

As discussed herein, the drilling fluid management system may adjust operation of the downhole drilling system based on identifying the lost-circulation event.

In some embodiments, generating the expected MSE and the expected pressure may include generating the expected MSE and the expected pressure for each segment of the plurality of segments. In some embodiments, generating the expected MSE and the expected standpipe pressure includes identifying known anomalies in the MSE and the standpipe pressure.

In some embodiments, as discussed herein, the plurality of drilling segments includes a plurality of MSE segments and a plurality of standpipe pressure segments. Applying the changepoint model to the plurality of segments may include applying the changepoint model to the MSE to identify the plurality of MSE segments and applying the changepoint model to the standpipe pressure to identify the plurality of standpipe pressure segments.

In some embodiments, generating the expected MSE includes generating the expected MSE for each MSE segment of the plurality of MSE segments and generating the expected standpipe pressure includes generating the expected standpipe pressure for each pressure segment of the plurality of pressure segments. In some embodiments, identifying the lost-circulation event includes identifying that the MSE differs from the expected MSE in a lost-circulation segment by an MSE threshold and identifying that the standpipe pressure in the lost-circulation segment differs from the expected standpipe pressure in the lost-circulation segment by a pressure threshold.

As mentioned, FIG. 7 illustrates a flowchart of a method 787 or a series of acts for managing a drilling fluid, according to at least one embodiment of the present disclosure. While FIG. 7 illustrates acts according to one embodiment, alternative embodiments may omit, add to, reorder, and/or modify any of the acts shown in FIG. 7. The acts of FIG. 7 may be performed as part of a method. Alternatively, a computer-readable medium may comprise instructions that, when executed by one or more processors, cause a computing device to perform the acts of FIG. 7. In some embodiments, a system may perform the acts of FIG. 7.

A drilling fluid management system may measure drilling parameters for a downhole drilling system at 788. The drilling parameters may include standpipe pressure. The drilling fluid management system may determine, based on the drilling parameters, an MSE for the downhole drilling system at 789. The drilling fluid management system may apply a changepoint model to the MSE and the standpipe pressure to identify a plurality of MSE segments and a plurality of pressure segments at 790. Each MSE segment has a segment MSE and each pressure segment has a segment pressure.

The drilling fluid management system may identify an expected MSE for each MSE segment of the plurality of MSE segments and an expected pressure for each pressure segment of the plurality of pressure segments at 791. The drilling fluid management system may identify an MSE segment of the plurality of MSE segments having the segment MSE that differs from the expected MSE in the MSE segment by an MSE threshold at 792. The drilling fluid management system may further identify a pressure segment of the plurality of pressure segments having the segment pressure that differs from the expected pressure in the pressure segment by a pressure threshold at 792.

The drilling fluid management system may identify a lost-circulation period based on an overlap of the MSE segment and the pressure segment at 793. For example, the lost-circulation period may be the period in which the MSE segment having the MSE less than the expected MSE overlaps the pressure segment having the pressure segment less than the expected pressure. The lost-circulation period may be the minimum period in which the lost-circulation event occurs.

As discussed herein, the drilling fluid management system may, based on identifying the lost-circulation period, implement a mitigating activity in the downhole drilling system.

Figure 8:
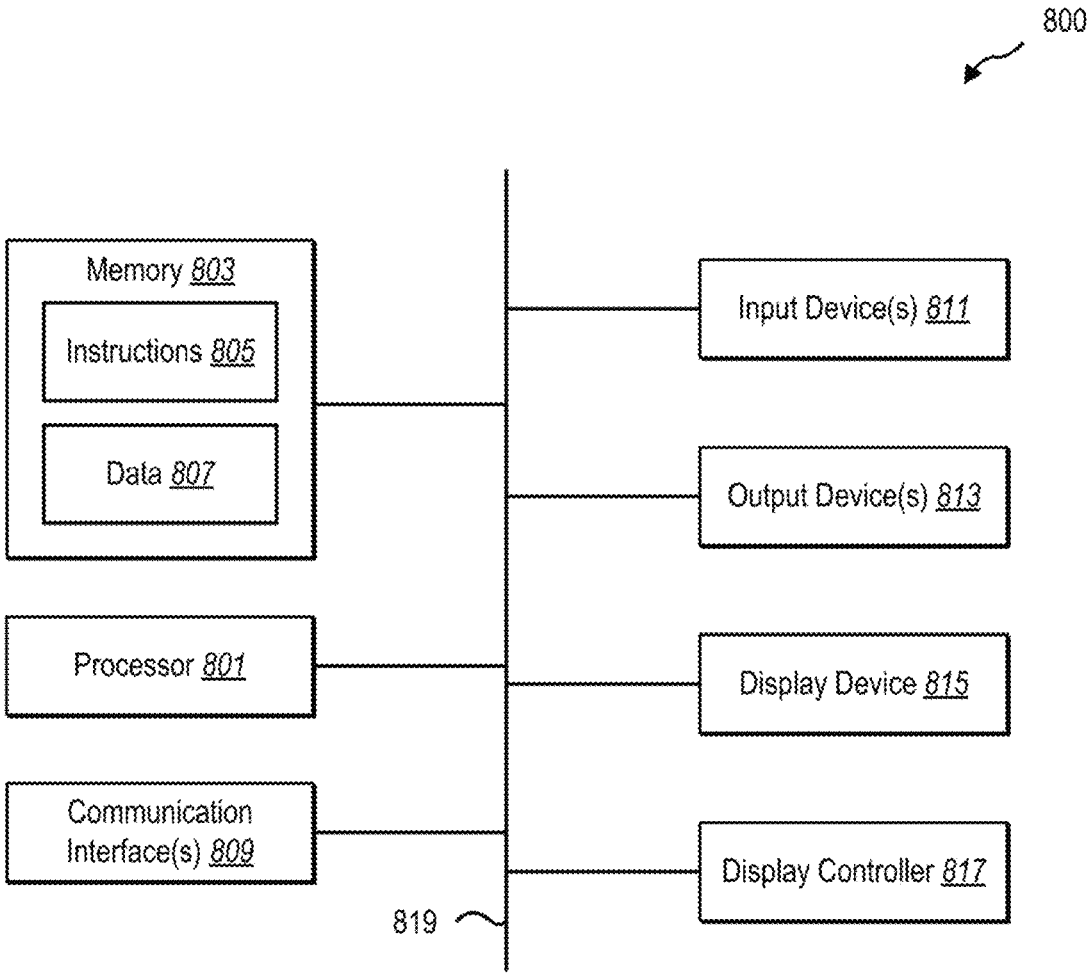
FIG. 8 is a representation of a computing system, according to at least one embodiment of the present disclosure.

FIG. 8 illustrates certain components that may be included within a computer system 800. One or more computer systems 800 may be used to implement the various devices, components, and systems described herein.

The computer system 800 includes a processor 801. The processor 801 may be a general-purpose single or multi-chip microprocessor (e.g., an Advanced RISC (Reduced Instruction Set Computer) Machine (ARM)), a special purpose microprocessor (e.g., a digital signal processor (DSP)), a microcontroller, a programmable gate array, etc. The processor 801 may be referred to as a central processing unit (CPU). Although just a single processor 801 is shown in the computer system 800 of FIG. 8, in an alternative configuration, a combination of processors (e.g., an ARM and DSP) could be used.

The computer system 800 also includes memory 803 in electronic communication with the processor 801. The memory 803 may be any electronic component capable of storing electronic information. For example, the memory 803 may be embodied as random access memory (RAM), read-only memory (ROM), magnetic disk storage media, optical storage media, flash memory devices in RAM, on-board memory included with the processor, erasable programmable read-only memory (EPROM), electrically erasable programmable read-only memory (EEPROM) memory, registers, and so forth, including combinations thereof.

Instructions 805 and data 807 may be stored in the memory 803. The instructions 805 may be executable by the processor 801 to implement some or all of the functionality disclosed herein. Executing the instructions 805 may involve the use of the data 807 that is stored in the memory 803. Any of the various examples of modules and components described herein may be implemented, partially or wholly, as instructions 805 stored in memory 803 and executed by the processor 801. Any of the various examples of data described herein may be among the data 807 that is stored in memory 803 and used during execution of the instructions 805 by the processor 801.

A computer system 800 may also include one or more communication interfaces 809 for communicating with other electronic devices. The communication interface(s) 809 may be based on wired communication technology, wireless communication technology, or both. Some examples of communication interfaces 809 include a Universal Serial Bus (USB), an Ethernet adapter, a wireless adapter that operates in accordance with an Institute of Electrical and Electronics Engineers (IEEE) 802.11 wireless communication protocol, a Bluetooth® wireless communication adapter, and an infrared (IR) communication port.

A computer system 800 may also include one or more input devices 811 and one or more output devices 813. Some examples of input devices 811 include a keyboard, mouse, microphone, remote control device, button, joystick, trackball, touchpad, and lightpen. Some examples of output devices 813 include a speaker and a printer. One specific type of output device that is typically included in a computer system 800 is a display device 815. Display devices 815 used with embodiments disclosed herein may utilize any suitable image projection technology, such as liquid crystal display (LCD), light-emitting diode (LED), gas plasma, electroluminescence, or the like. A display controller 817 may also be provided, for converting data 807 stored in the memory 803 into text, graphics, and/or moving images (as appropriate) shown on the display device 815.

The various components of the computer system 800 may be coupled together by one or more buses, which may include a power bus, a control signal bus, a status signal bus, a data bus, etc. For the sake of clarity, the various buses are illustrated in FIG. 8 as a bus system 819.

The embodiments of the drilling fluid management system have been primarily described with reference to wellbore drilling operations; the drilling fluid management systems described herein may be used in applications other than the drilling of a wellbore. In other embodiments, drilling fluid management systems according to the present disclosure may be used outside a wellbore or other downhole environment used for the exploration or production of natural resources. For instance, drilling fluid management systems of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A method for identifying a lost-circulation event in a downhole drilling system, the method comprising:

measuring drilling parameters for the downhole drilling system, the drilling parameters including standpipe pressure;

determining, based on the drilling parameters, a mechanical specific energy (MSE);

applying a changepoint model to the MSE and the standpipe pressure to identify a plurality of MSE segments and a plurality of pressure segments, each MSE segment having a segment MSE and each pressure segment having a segment pressure;

identifying a lost-circulation period based on an overlap of a difference between an expected MSE and the segment MSE and an expected pressure and the segment pressure;

using the lost-circulation period, identifying a mitigating action, the mitigating action including an additive amount and an additive schedule of an additive to a drilling fluid; and implementing the mitigating action by adding the additive to the drilling fluid with the additive amount and according to the additive schedule.

2. The method of claim 1, wherein measuring the drilling parameters includes measuring torque, rotation per minute (RPM), rate of penetration (ROP), and weight-on-bit (WOB), and wherein determining the MSE includes determining the MSE using the torque, the RPM, the ROP, and the WOB.

3. The method of claim 1, further comprising:

identifying the expected MSE for each MSE segment of the plurality of MSE segments and the expected pressure for each pressure segment of the plurality of pressure segments; and identifying an MSE segment of the plurality of MSE segments having the segment MSE that differs from the expected MSE in the MSE segment by an MSE threshold, and a pressure segment of the plurality of pressure segments having the segment pressure that differs from the expected pressure in the pressure segment by a pressure threshold, and wherein identifying the lost-circulation period is based on the overlap of the MSE segment and the pressure segment.

4. The method of claim 1, wherein identifying the lost-circulation period includes identifying the lost-circulation period based on a period of time over which the segment MSE and the segment pressure overlap.

5. The method of claim 1, wherein the segment MSE and the segment pressure have at least one of a different start time, end time, or duration.

6. The method of claim 1, wherein an MSE quantity of the plurality of MSE segments is different than a pressure quantity of the plurality of pressure segments.

7. The method of claim 1, wherein identifying the lost-circulation period includes identifying a void.

8. A downhole drilling system, comprising:

a plurality of drilling parameter sensors; and a processor and memory, the memory including instructions that cause the processor to:

measure drilling parameters with the plurality of drilling parameter sensors, the drilling parameters including standpipe pressure;

determine, based on the drilling parameters, a mechanical specific energy (MSE);

apply a changepoint model to the MSE and the standpipe pressure to identify a plurality of MSE segments and a plurality of pressure segments, each MSE segment having a segment MSE and each pressure segment having a segment pressure;

identify a lost-circulation period based on an overlap of a difference between an expected MSE and the segment MSE and an expected pressure and the segment pressure;

using the lost-circulation period, identifying a mitigating action, the mitigating action including an additive amount and an additive schedule of an additive to a drilling fluid; and implementing the mitigating action by adding the additive to the drilling fluid with the additive amount and according to the additive schedule.

9. The downhole drilling system of claim 8, wherein measuring the drilling parameters includes measuring torque, rotation per minute (RPM), rate of penetration (ROP), and weight-on-bit (WOB), and wherein determining the MSE includes determining the MSE using the torque, the RPM, the ROP, and the WOB.

10. The downhole drilling system of claim 8, wherein the instructions further cause the processor to:

identify the expected MSE for each MSE segment of the plurality of MSE segments and the expected pressure for each pressure segment of the plurality of pressure segments; and identify an MSE segment of the plurality of MSE segments having the segment MSE that differs from the expected MSE in the MSE segment by an MSE threshold, and a pressure segment of the plurality of pressure segments having the segment pressure that differs from the expected pressure in the pressure segment by a pressure threshold, and wherein identifying the lost-circulation period is based on the overlap of the MSE segment and the pressure segment.

11. The downhole drilling system of claim 8, wherein identifying the lost-circulation period includes identifying the lost-circulation period based on a period of time over which the segment MSE and the segment pressure overlap.

12. The downhole drilling system of claim 8, wherein the segment MSE and the segment pressure have at least one of a different start time, end time, or duration.

* * * * *